United States Patent [19]

Berk et al.

[11] 4,056,677

[45] Nov. 1, 1977

[54] ELECTRODE SYSTEM FOR RESISTANCE FURNACE

[75] Inventors: Charles W. Berk, St. Joseph; Charles B. Vallance, Berrien Springs, both of Mich.

[73] Assignee: Leco Corporation, St. Joseph, Mich.

[21] Appl. No.: 677,930

[22] Filed: Apr. 19, 1976

[51] Int. Cl.[2] ..... H05B 3/08; F27D 11/02

[52] U.S. Cl. ..... 13/23; 219/426

[58] Field of Search ..... 13/20, 23, 25, 27; 23/230 PC, 253 PC; 200/248, 279, 287; 219/426, 427

[56] References Cited

U.S. PATENT DOCUMENTS 3,636,229 1/1972 Sitek et al. ..... 13/25

FOREIGN PATENT DOCUMENTS 80,123 2/1963 France ..... 200/279

*Primary Examiner*—R. N. Envall, Jr.

*Attorney, Agent, or Firm*—Price, Heneveld, Huizenga & Cooper

[57] ABSTRACT

An electrode system for resistance furnace includes a pair of electrodes, one of which is movable to selectively clamp a resistive crucible between the electrodes. A specimen placed in the crucible is combusted by the application of electrical power to the electrodes in electrical contact with the crucible. One of the electrodes includes a demountable housing extending therefrom for surrounding a crucible held between the electrodes and sealing the crucible between the electrodes. The demountable housing permits easy cleaning of the system by removal of the housing. In one embodiment one of the electrodes includes a surface configurated to engage the crucible and provide self-centering of the crucible as the electrodes are moved to clamp the crucible therebetween.

15 Claims, 2 Drawing Figures

ELECTRODE SYSTEM FOR RESISTANCE FURNACE

BACKGROUND OF THE DISCLOSURE

The present invention relates to an electrode system for a resistance heating furnace.

In resistive furnaces which employ conductive crucibles for the combustion of a specimen for subsequent analysis by an analytical instrument, during the heating of the combustion of the specimen at temperatures in the neighborhood of 2500° C or even higher the electrodes between which the resistive crucible is clamped become contaminated by the byproducts of combustion. Thus it is necessary after at least the running of a few specimens to clean the electrode surfaces, including the interior cavity of the electrodes into which the crucible is fitted. In the past, known electrode systems have been of a two-piece construction with one of the electrodes defining a cavity into which the crucible extends. Such construction is represented by U.S. Pat. No. 3,936,587 issued on Feb. 3, 1976, to Sitek et al. and assigned to the present assignee. Such electrode construction, although performing well, requires frequent cleaning typically with a special cleaning brush or the like which must be extended into the electrodes for their cleaning.

Further with the prior at electrode construction, although the lower electrodes included a pedestal for centering the crucible thereon before the electrodes are brought together clamping the crucible therebetween; on some occasions the crucible does not center properly. As a result when the crucible is clamped between the electrodes, it may be crushed, or poor electrical contact is made between the electrode and the upper rim of the typically cylindrical crucible. This, of course, reduces the resistance heating of the crucible due to a reduction in electrical current through the crucible.

SUMMARY OF THE INVENTION

In order to overcome the deficiencies of the prior art, the present invention includes a pair of electrodes between which a crucible is clamped and demountably coupled to one of the electrodes is a housing surrounding the crucible and sealed between the pair of electrodes. Such construction permits removal of the demountable section and therefore easy access to the pair of electrodes as well as the interior of the demountable housing. Such construction, therefore, readily permits cleaning of the electrode system without requiring special brushes or the like.

According to a further aspect of the present invention, for use in systems employing crucibles having an annular upper rim, the electrode engaging the rim of the crucible has a concavely curved crucible engaging seat for centering the crucible as the electrodes are brought together for clamping the crucible therebetween.

These and other improvements, features and advantages of the present invention can best be understood by reference to the following description thereof together with the drawings in which:

DETAILED DESCRIPTION OF THE PREFERRED EMBODIMENT

Figure 1:
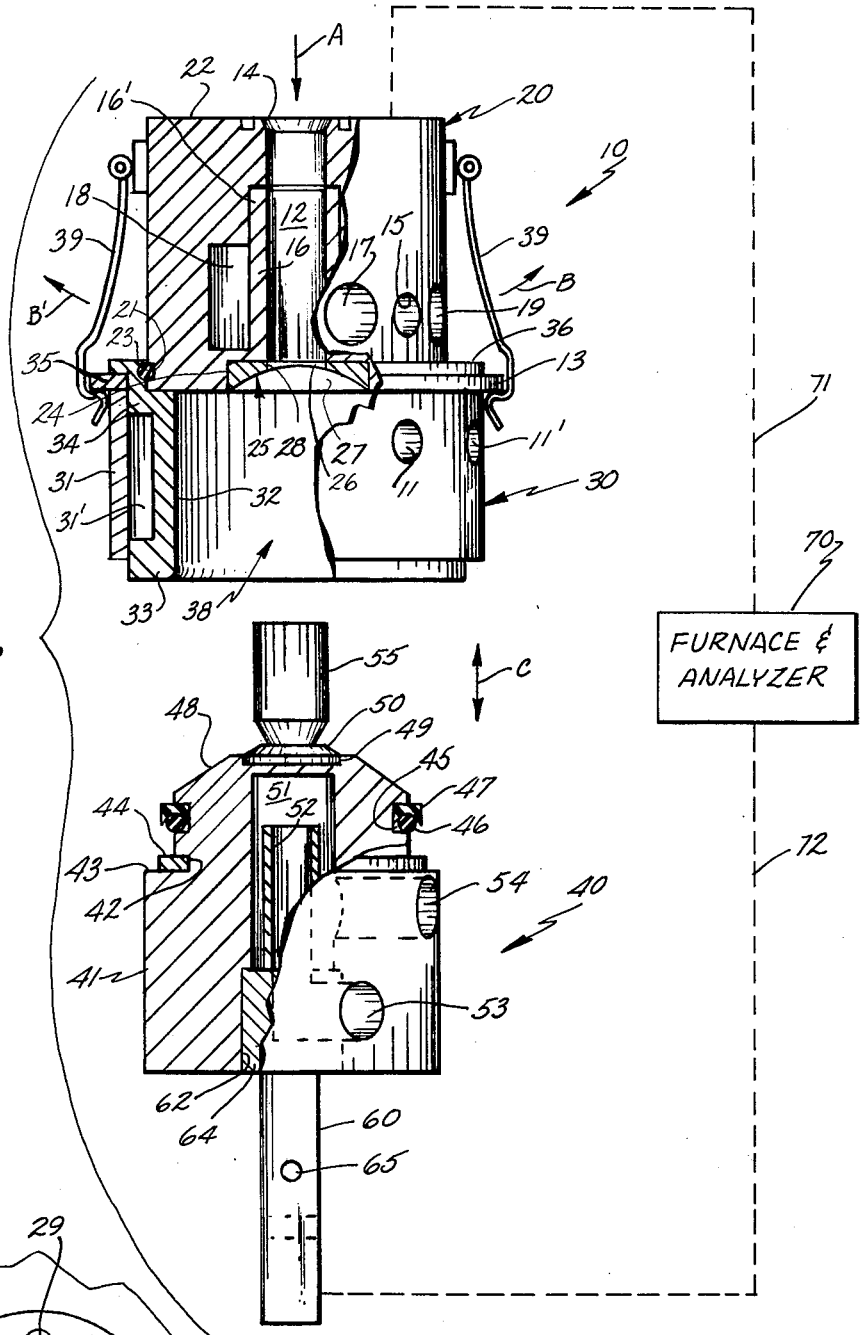
FIG. 1 is a side elevational view partly in cross-section and partly in schematic form of the electrode system of the present invention.

The electrode system 10 of the present invention is adapted for use with a resistance heating furnace and analyzer system 70 generally of the type referred to in the above identified U.S. Pat. No. 3,936,587, the disclosure of which is incorporated herein by reference. The analyzer 70 is shown schematically in FIG. 1, and is understood to include an electrical power supply coupled to the electrode system 10 as indicated by the dotted lines 71 and 72. Unit 70 also includes suitable conduits for the removal of byproducts of combustion from the electrode system into the analyzer portion of the instrument and providing cooling water to the electrodes. Furnace 70 also includes a raising and lowering mechanism coupled to the lower electrode 40 for raising it upwardly and crucible 55 supported thereon into the interior cavity of the upper electrode 10 and housing 30.

The electrode system 10 of the preferred embodiment invention consists basically of an upper electrode 20 which is stationary and to which there is demountably or releasably coupled by means of clips 39, a cylindrical demontable housing or intermediate electrode section 30. The assembly further includes a lower electrode 40 for supporting thereon a crucible 55 generally of the type disclosed and described in U.S. Pat. No. 3,899,627 issued Aug. 12, 1975, to Sitek et al., assigned to the present assignee, and the disclosure of which is incorporated herein by reference. Lower electrode 40 is movable upwardly and downwardly in a direction indicated by arrow C such that the crucible 55 engages a concavely curved seat 25 providing electrical contact between the upper electrode and the crucible during combustion of a specimen positioned within the crucible. Having briefly described the overall system, a detailed description of, first, the upper electrode 20 is presented followed by a description of housing 30 and lower electrode 40.

The upper electrode 20 comprises a generally cylindrical copper body 22 having formed centrally and longitudinally therethrough a cylindrical bore 12 flared at its upper end 14 for receiving a sample or specimen to be dropped into a crucible by loading mechanism disclosed in the first above identified U.S. patent. Bore 12 also permits the admission of an inert carrier gas into the crucible for sweeping the byproducts of combustion from the electrode assembly through outlet 15 which communicates with the lower end of bore 12. An annular water jacket 18 is machined into the cylindrical body 22 of the upper electrode and a cylindrical insert 16 closes the water jacket and is secured within a cylindrical recess 16' in body 22 by means of soldering or other suitable means. The interior diameter of insert 16 is the same as the remainder of bore 12 and is co-extensive with and in part defines the bore.

The annular water jacket 18 extends around approximately 270° of the bore 12 and is interrupted by the horizontally opposite walls of outlet 15. A water inlet 17 communicates with one end of bore 18 while water outlet 19 communicates with the opposite end. This arrangement permits water to be supplied to the upper electrode for cooling during operation of the furnace. At the lower peripheral outer end of electrode 20 there is provided an annular recess 21 for receiving a sealing O-ring 23 which provides a sealed coupling between housing 30 and the upper electrode as seen in FIG. 1.

Pivotally coupled at opposite sides to the upper portion of electrode 20 are spring steel retaining clips 39 which releasably engage a retainer ring 13 fitted in the housing 30 as described below. Clips 39 are of the type employed for distributor caps used in the automotive industry and when in the position shown in FIG. 1 securely hold the demountable housing 30 to the upper electrode 20. These spring clips can be pivoted outwardly as indicated by arrows B in the Figure for releasing housing 30 for cleaning.

The lower end of bore 12 terminates in a crucible engaging seat 25 surrounding the end of bore 12. In the embodiment seat 25 comprises an annular insert 25 having a generally flat annular surface 26 silver soldered to the annular bottom surface of insert 16 and to annular seating surface formed within body 22 of the upper electrode. Insert 25 is made of, in the preferred embodiment, of tungsten, a tungsten alloy or a commercially available pressed material comprising a mixture of 75% tungsten and 25% copper. The bottom surface 27 of insert 25 is concavely shaped as seen in FIG. 1 with insert 25 having a diameter significantly greater than that of the cylindrical crucible 55.

Figure 2:
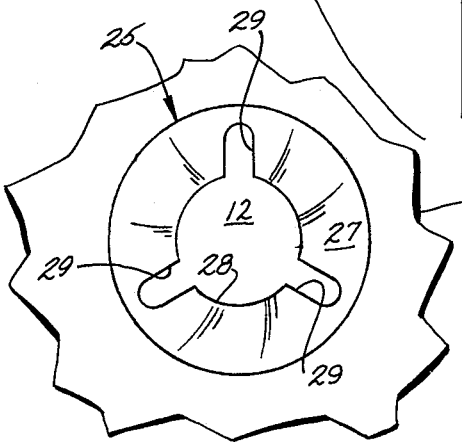
FIG. 2 is an enlarged fragmentary bottom plan view of the upper electrode shown in FIG. 1.

Extending through insert 25 as best seen in FIG. 2, is an aperture 28 communicating with bore 12 and permitting the carrier gas and the sample to enter the open mouth of crucible 55. In order to permit combustion byproducts to escape the crucible and exit through port 15, three slots 29 extend vertically through the insert and extend radially outwardly from aperture 28 and are positioned at approximately 120° intervals as best seen in FIG. 2. The concavely rounded lower surface 27 of member 25 serves to securely seat the curcible 55 to the surface 27 when the lower electrode is in its raised position. Insert 25 accomplishes this by the concave lower surface which when crucible 55 is slightly off center provides a mating surface which will engage substantially the periphery of the top edge of the crucible. If the crucible is off center a considerable distance, the concave surface 27 will actually force the crucible into aligned seating engagement as the crucible is brought against insert 25.

Although in the preferred embodiment a separate insert 25 is employed, in some embodiments where extreme durability of the electrodes is not required; the surface surrounding the lower end of bore 12 can be machined in a concavely curved fashion to provide the desired configuration. In the preferred embodiment for use with a crucible having an outer cylindrical diameter of approximately 0.56 inches and an inner diameter of 0.48 inches, insert 25 had an outer diameter of about 0.87 inches with aperture 28 having a diameter of about 0.31 inches. The radius of curvature of the concave surface 27 was about 0.62 inches and was spherical.

The demountable housing or intermediate electrode section 30 comprises a generally cylindrical copper outer sleeve 31 enclosing a water jacket 31' surrounded on three sides by an inner cylindrical copper sleeve 32 having a lower peripheral flange 33 and an upper peripheral flange 34. Extending upwardly from flange 34 is a vertically extending annular shoulder 35 terminating in an outwardly extending lip 36. Fitted under lip 36, and between lip 36 and sleeve 31 which is soldered to cylinder 32; is a split ring retainer 13 comprising a two-section flat steel washer having interlocking ends and a type generally commercially available. Retainer 13 extends outwardly from the outer surface of sleeve 31 sufficiently to permit the curved lower ends of clips 39 to extend thereunder for securely but releasably holding housing 30 to upper electrode 20. The inner surface of vertically extending shoulder 35 compresses against O-ring 23 to provide a sealed interconnection between housing 30 and the upper electrode 20 when in the attached position shown in FIG. 1.

The cylindrical sleeve 32 defines a downwardly depending central opening or cavity 38 into which the lower electrode and crucible extend when the electrodes are in a closed position. The water jacket 31' extends substantially around housing 30 and terminates at one end with a water inlet port 11 and at its opposite end at a water outlet port 11' to which there are coupled suitable water interconnections for cooling the housing during furnace operation. Preferably the connecting water hoses are flexible permitting the housing 30 to be moved from the upper electrode area when clips 39 are opened and housing 30 detached from electrode 20.

Lower electrode 40 comprises a generally cylindrical copper body 41 having an upper end defining a pedestal on which crucible 55 is positioned. An annular recess 42 is machined in the lower electrode and receives a flat annular Viton washer 44. Spaced above seal 44 is a second annular recess 45 formed in the pedestal portion of electrode 40 for receiving a combined O-ring 46 and flat Viton seal 47 providing sealing means between the outer periphery of the pedestal portion of electrode 40 and the interior cylindrical wall of housing 30. The top portion of the pedestal is chamfered as seen at 48 and cut horizontally flat at its top. An annular recess 49 is formed centrally therein for receiving an insert 50 of construction substantially identical to an insert employed in the above referred U.S. Pat. No. 3,936,587, and the disclosure of which is incorporated herein by reference. Basically insert 50 includes a central aperture for receiving a downwardly depending buttonlike projection centrally located in and extending from the floor of carbon crucible 55. Insert 50 is made of the same material as insert 25 of the upper electrode. In order to cool lower electrode 40 there is provided a cooling water jacket 51 communicating with a water inlet 53 and water injection tube 52. Water jacket 51 further communicates with a water outlet port 54 extending through the side wall of the cylindrical body 41. A mounting shaft 60 is provided and is fitted within recess 62 formed through the bottom of body 41 by means of a coupling plug 64. Shaft 60 includes a pair of orthogonally extending apertures 65 permitting coupling of the shaft to a coupling for attaching it to a pneumatic cylinder for raising and lowering the lower electrode into and out of the housing 30 in directions indicated by arrow C. Having described the structure defining the present invention, a brief description of its operation is now presented.

OPERATION

In operation a crucible 55 is positioned on the pedestal of the lower electrode 40 within the insert 50 and the lower electrode is raised upwardly such that the upper edge of crucible 55 seatably engages insert 25 of the upper electrode 20. As this occurs, seal members 46 and 47 engage the inner peripheral side wall of sleeve 32 of housing 30 thereby sealing the interconnection between lower electrode 40 and housing 30. In the event the crucible is inadvertantly fractured or the electrodes are closed with no crucible in position, the washer 44 will seat against the lower surface of flange 33 preventing a direct short between the upper electrode assembly and the lower electrode causing a short circuit of the power supply coupled to the electrode for supplying electrical power to crucible 55. Housing 30 may, of course, be made of a non-conductive material to also eliminate this problem. Washer 44, however, is not required to provide the desired sealed connection between housing 30 and electrode 40.

Once in the closed position electrical power is applied to the carbon crucible through its engagement at its lower end with insert 50; and therefore, electrode 40 and at its upper end through insert 25 and electrode 20 to combust a specimen within the crucible by direct resistance heating of the crucible. At this time water is circulated through the respective water jackets of the three elements forming the electrode system to maintain their temperature well below the melting point of the material used for the various elements which is typically copper. The inserts 25 and 50 are of relatively high melting point material such as tungsten or an alloy which has a melting point in excess of 2500° C; and therefore, the extremely high temperatures to which the crucible is heated do not affect the contact point between the crucible and the electrode assembly. At the same time as the crucible 55 is heated, an inert carrier gas such as helium is injected through bore 12 in the direction indicated by arrow A and passes through aperture 28 in insert 25 into the mouth of crucible 55 whereby byproducts of combustion are mixed with the carrier gas and exit through port 15. Coupled to port 15 is the gas inlet to the analyzer 70 which includes detecting means for detecting specific compounds such as carbon or sulfer carried within the specimen and in the gaseous byproducts as the result of the combustion of the specimen.

Once specimen combustion is completed the lower electrode 40 is withdrawn into a position shown in FIG. 1 and the crucible 55 removed. After several successive analysis and cycles of operation of the system, deposits typically will build up on the surfaces of the electrodes including the inserts 25 and 50 as well as on the side walls of housing 30. In order to easily clean the upper electrode 20 and expose the surfaces of the upper electrode, clips 39 are opened and the housing 30 dropped and moved to the side permitting direct access with a cleaning cloth to the bottom surface of electrode 20. Also the interior surfaces of housing 30 can easily be cleaned with a cloth. By providing the demountable housing 30, therefore, direct and easy access to the upper electrode is obtained without the need of special tools, mirrors or other aids of inspection and cleaning. In the prior art systems, even when the furnace was in an open position the lower electrode 40 would tend to interfer with the cleaning process which is greatly facilitated by the improved system of the present invention.

It will become apparent to those skilled in the art that various modifications to the preferred embodiment described herein can be made. Thus, for example, the demountable housing 30 could be demountably coupled to the lower electrode 40 so long as the lower and upper electrodes were sealed by the housing which surrounds the crucible during combustion of a specimen. Also as noted above, the self-centering concave surface in the upper electrode need not be formed on an insert but could be machined directly into the electrode. These and other modifications will, however, fall within the spirit and scope of the present invention as defined by the appended claims.

The embodiments of the invention in which and exclusive property or privilege is claimed are defined as follows.

1. An electrode system for use in a resistance furnace employing a resistive crucible for combusting a specimen positioned in the crucible, said system comprising:

a pair of opposed electrodes of electrically conductive material, one of said electrodes being movable for selectively holding a crucible between said pair of electrodes; and an intermediate electrode section including a central cavity for receiving a crucible, said intermediate electrode section demountably coupled to one electrode of said pair of electrodes to facilitate cleaning of said electrode system when said intermediate electrode section is removed.

2. The system as defined in claim 1 wherein said pair of electrodes include a stationary upper electrode and a movable lower electrode spaced below said upper electrode and wherein said intermediate electrode section is demountably coupled to said upper electrode.

3. The system as defined in claim 2 wherein said intermediate electrode includes means for sealably engaging said upper and said lower electrodes such that the crucible is sealably enclosed by said electrode system when held between said upper and lower electrodes.

4. The system as defined in claim 3 and further including clip means extending between said upper electrode and said intermediate electrode section for demountably coupling said intermediate electrode section to said upper electrode.

5. The system as defined in claim 4 wherein said intermediate electrode section includes a retainer ring and wherein said clip means comprises a pair of spaced spring clips pivotally coupled at one end to said upper electrode and including an opposite end configurated to releasably engage said retainer ring.

6. The system as defined in claim 5 wherein said upper electrode includes a concavely curved surface for engaging the upper rim of a crucible for providing selfcentering of the crucible and for improving the electrical contact between the crucible and said upper electrode when the crucible is held between said upper and lower electrodes.

7. For use in a furnace for heating an electrically resistive crucible held between electrodes, improved electrode construction comprising:

a pair of electrodes made of an electrically conductive material for the passage of electrical current therethrough, at least one of said electrodes movable toward and away from the remaining electrode for alternately clamping and releasing a free standing cylindrical shaped open ended electrically resistive specimen holding crucible between said electrodes wherein the electrode engaging the open end of the crucible includes a concavely curved surface facing the crucible for centering the crucible and assuring electrical contact between the crucible and said electrodes, and the remaining electrode includes a pedestal for supporting the free standing crucible.

8. The apparatus as defined in claim 7 wherein said electrode engaging the open end of the crucible includes a body of electrically conductive material and an insert coupled to said body and made of an electrically conductive material having a melting point greater than about 2500° C and wherein said concavely curved surface is formed in said insert.

9. For use in a furnace for heating an electrically resistive crucible held between electrodes, improved electrode construction comprising:

a pair of electrodes made of an electrically conductive material, at least one of said electrodes movable toward and away from the remaining electrode for alternately clamping and releasing a cylindrical shaped open ended electrically resistive specimen holding crucible between said electrodes wherein the electrode engaging the open end of the crucible includes a concavely curved surface facing the crucible for centering the crucible and assuring electrical contact between the crucible and said electrodes, and an intermediate electrode section positioned between said pair of electrodes to surround a crucible positioned between said pair of electrodes and wherein said intermediate electrode section is demountably secured to one electrode of said pair of electrodes.

10. The apparatus as defined in claim 9 and including means for sealing said intermediate electrode section to each electrode of said pair of electrodes when a crucible is in position between said pair of electrodes.

11. For use in a furnace for combusting a specimen positioned in a resistance heated crucible, an improved electrode system comprising:

a conductive first electrode comprising a generally cylindrical body including a central bore extending longitudinally therethrough, said bore terminating at one end at a crucible engaging seat surrounding said one end of said bore, a generally cylindrical housing having an inner diameter sufficient to permit a crucible to be positioned within said housing, means for releasably securing said housing in sealed relationship to said first electrode; and a conductive second electrode including a crucible engaging seat and seal means for sealing the junction of said second electrode and said housing when said second electrode is moved toward said first electrode to hold a crucible between said electrodes.

12. The system as defined in claim 11 wherein said crucible engaging seat in said first electrode is concavely rounded.

13. The system as defined in claim 12 wherein said crucible engaging seat of said first electrode is made of a conductive material having a melting point greater than about 2500° C.

14. The system as defined in claim 13 wherein said crucible engaging seat of said first electrode comprises an annular insert secured to said first electrode and made of a conductive material including tungsten.

15. The system as defined in claim 11 wherein said housing includes a retainer ring and wherein said first electrode includes at least a pair of spaced spring clips for releasably engaging said retainer ring to releasably hold said housing to said first electrode.

* * * * *

UNITED STATES PATENT AND TRADEMARK OFFICE

CERTIFICATE OF CORRECTION

PATENT NO. : 4,056,677

DATED : November 1, 1977

INVENTOR(S) : Charles W. Berk, et al

It is certified that error appears in the above–identified patent and that said Letters Patent are hereby corrected as shown below:

Column 1; line 27:
"at" should be --art--

Column 3; line 33:
"curcible" should be --crucible--

Column 4; line 36:
"buttonlike" should be --button-like--

Column 5; line 54:
"interfer" should be --interfere--

Column 7; line 14:
", and" should be --; and--

Signed and Sealed this

*Fourth* Day of *July 1978*

[SEAL]

*Attest:*

RUTH C. MASON
*Attesting Officer*

DONALD W. BANNER
*Commissioner of Patents and Trademarks*